United States Patent [19]

Kraus

[11] Patent Number: 4,887,660

[45] Date of Patent: Dec. 19, 1989

[54] ROLL-UP DOOR

[75] Inventor: Thomas J. Kraus, Sherrill, Iowa

[73] Assignee: Frommelt Industries, Inc., Dubuque, Iowa

[21] Appl. No.: 213,696

[22] Filed: Jun. 30, 1988

[51] Int. Cl.[4] ..... A47G 5/02

[52] U.S. Cl. ..... 160/265; 160/310

[58] Field of Search ..... 160/265, 267.1, 7, 8, 160/310, 293.1, 294

[56] References Cited

U.S. PATENT DOCUMENTS

| | | |
|---|---|---|
| 5,097 | 5/1847 | Cate . |
| 297,163 | 4/1884 | Quigley . |
| 379,614 | 3/1888 | Smith . |
| 455,697 | 7/1891 | Wright . |
| 472,832 | 4/1892 | Sweeney . |
| 640,291 | 1/1900 | Forsyth . |
| 987,654 | 3/1911 | Thompson . |
| 1,088,139 | 2/1914 | Fischer . |
| 1,121,898 | 12/1914 | Davis . |
| 1,204,436 | 11/1916 | Hawley . |
| 1,355,246 | 10/1920 | Myvalt . |
| 1,513,676 | 10/1924 | Skurniak . |
| 1,545,053 | 7/1925 | Kelly . |
| 1,742,437 | 1/1930 | Davenport . |
| 1,828,623 | 10/1931 | Sacerdote . |
| 1,859,209 | 5/1932 | Kohlsaat . |
| 2,148,983 | 2/1939 | Grubb . |
| 2,564,208 | 8/1951 | Michelman . |
| 2,780,283 | 2/1957 | Wasserman . |
| 2,827,117 | 3/1958 | Bateman . |
| 2,839,135 | 6/1958 | Anderson . |
| 2,843,201 | 7/1958 | Laubenthal . |
| 3,050,743 | 8/1962 | Lamb . |
| 3,092,170 | 6/1963 | Ellis . |
| 3,180,401 | 4/1965 | Gambon et al. . |
| 3,211,211 | 10/1965 | Youngs . |
| 3,292,685 | 12/1966 | Clark . |
| 3,306,344 | 2/1967 | Youngs . |
| 3,306,345 | 2/1967 | Youngs . |
| 3,421,568 | 1/1969 | Youngs . |
| 3,430,677 | 3/1969 | Pierce . |
| 3,460,602 | 8/1969 | Hugus . |
| 3,583,465 | 6/1971 | Youngs et al. . |
| 3,734,161 | 5/1973 | Pierce . |
| 3,750,740 | 8/1973 | Newman . |
| 3,759,568 | 9/1973 | Unruh . |

(List continued on next page.)

FOREIGN PATENT DOCUMENTS

| | | |
|---|---|---|
| 1158 | 7/1886 | Denmark . |
| 1509590 | 5/1969 | Fed. Rep. of Germany . |
| 2341328 | 3/1974 | Fed. Rep. of Germany . |
| 3345016 | 6/1985 | Fed. Rep. of Germany . |
| 35084 | 3/1966 | Finland . |
| 369326 | 8/1974 | Sweden . |
| 7210759-2 | 8/1976 | Sweden . |
| 89785 | 12/1920 | Switzerland . |
| 240349 | 10/1925 | United Kingdom . |
| 1444017 | 7/1976 | United Kingdom . |

*Primary Examiner*—Blair M. Johnson

*Attorney, Agent, or Firm*—Emrich and Dithmar

[57] ABSTRACT

A lightweight, high speed roll-up door, or curtain, is unrolled from and rolled upon a cylindrical tube disposed above or within an opening in a wall by a drive motor/drive shaft combination coupled to one end of the tube. A non-rotating support shaft is attached to the other end of the tube which has disposed within respective ends thereof first and second coiled springs. A pair of belts are coupled to lower opposed ends of the door and are wrapped around respective pulleys positioned at each end of the tube and mounted to the drive and support shafts, respectively. With one end of each of the coiled springs coupled to the tube and each of the other ends respectively coupled to one of the pulleys, the coiled springs urge the two pulleys and the tube in opposite directions of rotation to maintain the door in a tightly stretched condition. Changes in the effective radius of each of the pulleys as the belts are unwound-/wound as well as changes in the effective radius of the tube as the door is unwound/wound counterbalance the door's weight by compensating for changes in the weight of the withdrawn, or extended, portion of the door to ensure high speed door operation regardless of the length of door withdrawn from the tube.

12 Claims, 2 Drawing Sheets

U.S. PATENT DOCUMENTS

| | | | |
|---|---|---|---|
| 3,842,892 | 10/1974 | Stieler . | |
| 3,853,167 | 12/1974 | Wardlaw . | |
| 3,878,879 | 4/1975 | Manns . | |
| 3,981,343 | 9/1976 | DeVito . | |
| 4,016,920 | 4/1977 | Shepard . | |
| 4,178,978 | 12/1979 | Burnham . | |
| 4,234,033 | 11/1980 | Leivenzon et al. . | |
| 4,237,956 | 12/1980 | Sivin et al. . | |
| 4,342,354 | 8/1982 | Leivenzon et al. . | |
| 4,359,846 | 11/1982 | Votteler . | |
| 4,392,392 | 7/1983 | Perisic et al. . | |
| 4,452,292 | 6/1984 | Leivenzon et al. . | |
| 4,467,853 | 8/1984 | Downey, Jr. . | |
| 4,478,268 | 10/1984 | Palmer | 160/310 |
| 4,665,965 | 5/1987 | Pasquier et al. | 160/7 X |
| 4,690,194 | 9/1987 | Seuster | 160/265 |

FIG. 1
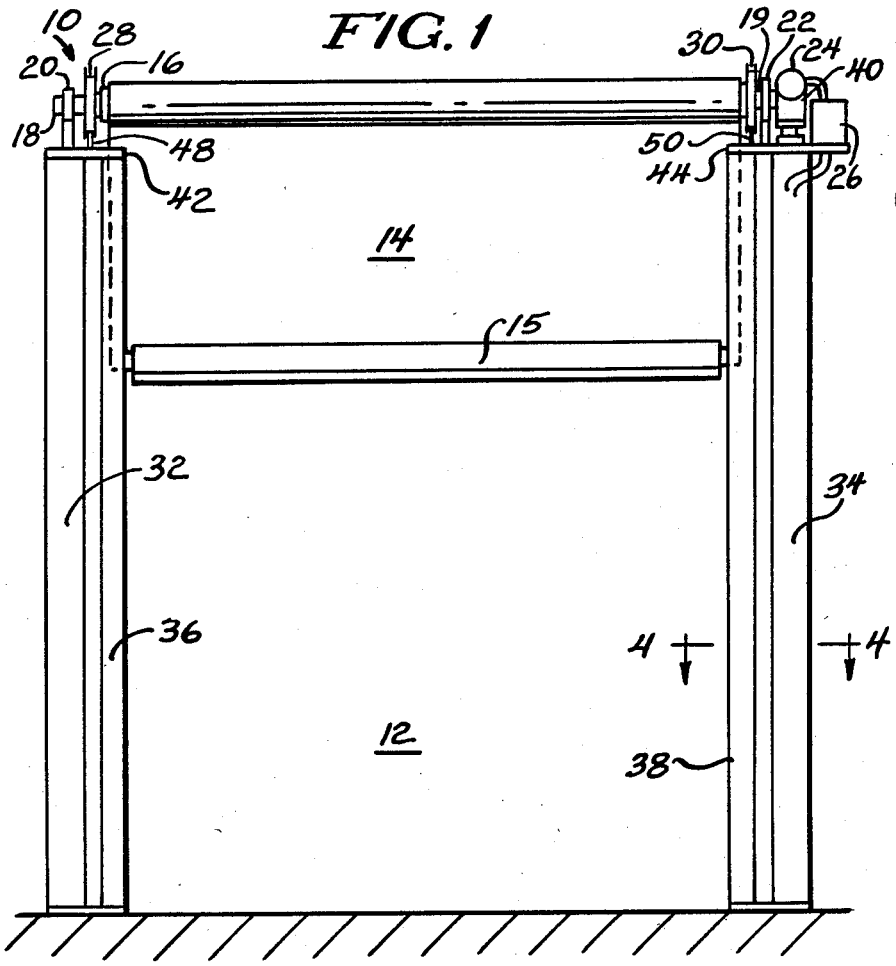
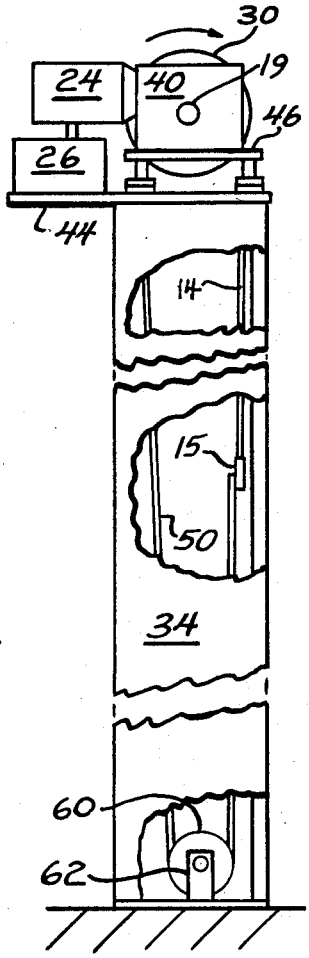
FIG. 2
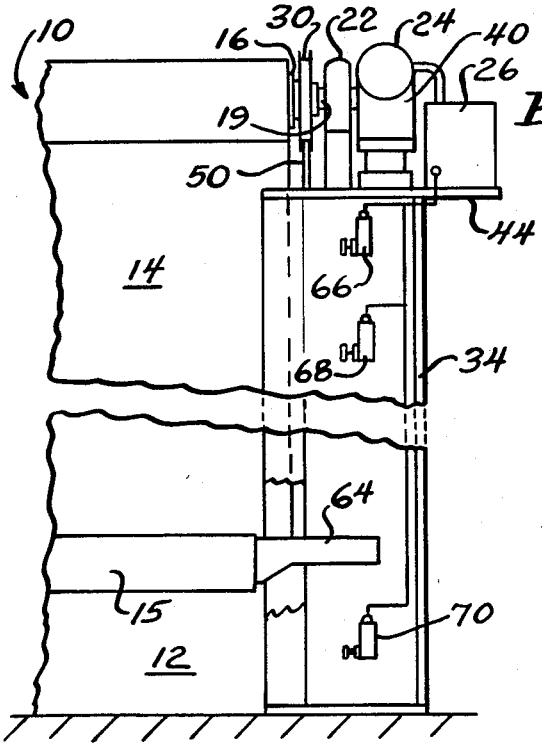
FIG. 3
FIG. 4
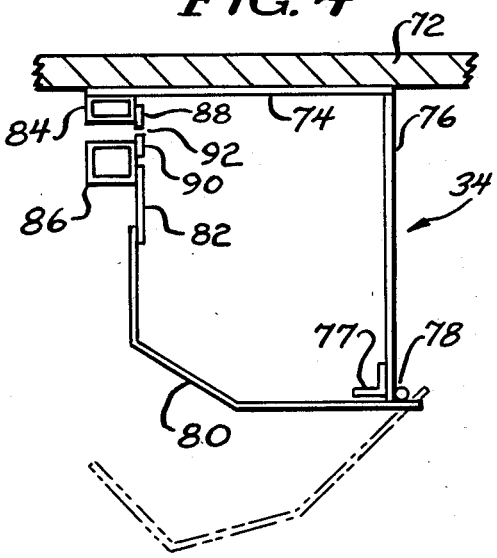

ROLL-UP DOOR

BACKGROUND OF THE INVENTION

This invention relates generally to overhead doors or curtains and is particularly directed to a lightweight roll-up door which can be lowered or raised at high speed.

Roll-type doors are frequently used in industrial installations to isolate two rooms or the inside of a building from the outside environment while permitting transit between the two rooms or either out of or into the building. Roll-up doors of the curtain type are generally secured at an upper end thereof to a tube-like roller which is rotated in a first direction to lower the door and in a second, opposite direction to retract the door. The roller is typically mounted immediately above the doorway and is generally rotationally displaced by an electric motor and drive assembly. Roll-type doors are generally comprised of a lightweight material to facilitate rapid displacement of the door and are also frequently transparent to allow for viewing through the doorway when the roll-type door is in the extended, closed position. These doors are typically comprised of a high strength plastic material such as polyvinyl chloride (PVC) and may be displaced from the open to the closed position, or vice versa, in just a few seconds. As this type of door lacks the structural strength of heavier multi-section hinged roll-type doors, these lightweight roll-type doors are intended primarily for environmentally isolating two adjacent rooms or the inside of a building from the outside environment rather than for providing security by preventing transit through a doorway. A rapidly displaced overhead roll-type door having good insulating characteristics is particularly desirable from an energy conservation standpoint where there is a large differential between inside and outside temperatures.

Pliable roll-type door tensioning arrangements typically include various combinations of springs, pulleys and weights to exert a downward force on the lower edge portion of the door in maintaining it generally planar across the doorway when extended. These arrangements in the past have tended to be overly complex and of limited reliability over extended periods of continued use. The present invention is intended to overcome the aforementioned limitations of the prior art by providing a high speed roll-type door which has a reduced number of parts while offering highly reliable performance.

OBJECTS AND SUMMARY OF THE INVENTION

Accordingly, it is an object of the present invention to provide an improved high speed, roll-up door.

It is another object of the present invention to provide a high speed roll-up door having a reduced number of parts which affords highly reliable operation.

Yet another object of the present invention is to provide counterbalancing for the weight of a roll-up door by compensating for changes in door roll-up torque with differential compensating changes in door extension, or withdrawal, torque.

A further object of the present invention is to maintain a high speed, flexible curtain-like roll-up door in a tightly stretched condition when extended and to maintain the retraction and extension forces applied to the door in equilibrium regardless of the length of door in the extended position.

This invention contemplates a roll-up door disposed across an aperture in a wall and comprised of a cylindrical tube disposed adjacent to an upper portion of the aperture; a flexible curtain coupled to and wound around the tube in a first direction of winding; a first support shaft coupled to a first end of the tube and a second drive shaft coupled to a second end of the tube, the drive shaft further coupled to drive means for rotationally displacing the tube; first and second pulleys respectively mounted to the first support shaft and the second drive shaft; first and second belt means respectively coupled to and wound around the first and second pulleys in a second, opposed direction of winding for coupling the pulleys to a free end of the curtain; and biasing means coupled to the tube and the pulleys for rotationally urging the tube in the first direction of winding for rolling up the curtain on the tube and for rotationally urging the pulleys in the second, opposed direction of winding for rolling up the belt means on the pulleys so as to maintain the curtain in a tightly stretched condition; wherein changes in the length of curtain unwound from the tube are compensated for by corresponding changes in a roll-up torque exerted on the belt means by the pulleys and biasing means so as to counterbalance the weight of curtain removed from the tube and maintain the curtain in equilibrium as it is unwound from and wound onto the tube.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 is a plan view of a roll-up door installation in accordance with the principles of the present invention;

FIG. 2 is a partially cutaway side view of the roll-up door of FIG. 1;

FIG. 3 is a partially cutaway planar view of a portion of the roll-up door of FIG. 1 illustrating details of a door control arrangement for use in the present invention;

FIG. 4 is a horizontal sectional view of a side panel of the roll-up door of FIG. 1 taken along sight line 4—4 therein;

DETAILED DESCRIPTION OF A PREFERRED EMBODIMENT

Figure 5:
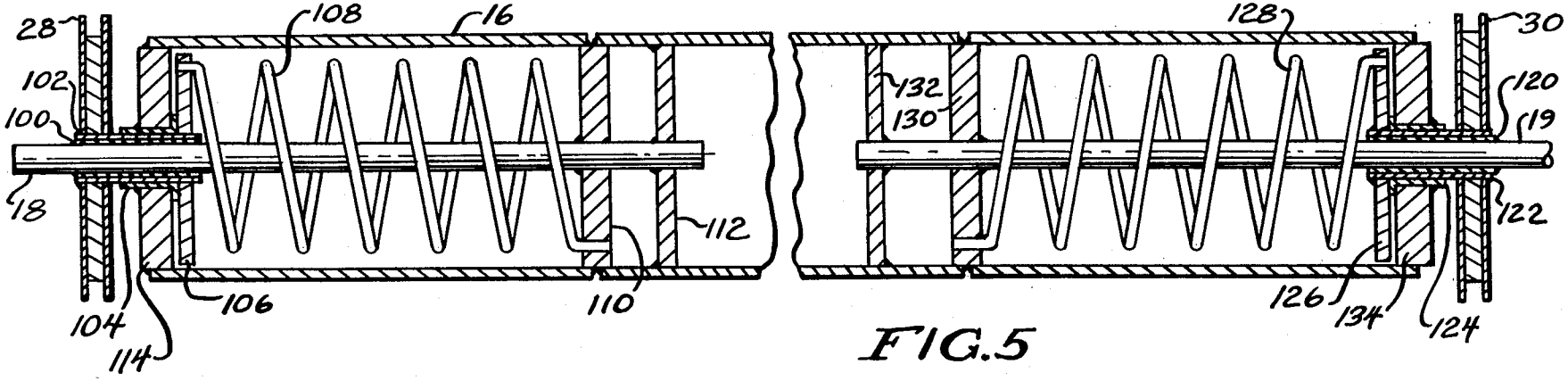
FIG. 5 is a partial sectional view of a roll tube, and components associated therewith, for use in the roll-up door of the present invention.

Referring to FIG. 1, there is shown a planar view of a roll-door 10 in accordance with the present invention. The roll-up door 10 includes first and second vertically aligned, parallel side frames 32 and 34 disposed on facing lateral edges of an opening 12 within a wall. Each of the first and second side frames 32, 34 is preferably comprised of metal and houses various components of the roll-up door 10 as described below. The side frames 32, 34 also provide support for the door positioned immediately adjacent to or within the opening 12. Disposed above or in an upper portion of the opening 12 is a generally horizontally oriented tube, or cylinder, 16 about which is wound a curtain 14. The curtain 14 is preferably comprised of a high strength, flexible, lightweight material such as polyvinyl chloride (PVC), which may be transparent. One end of the curtain 14 is securely attached to the tube 16 along substantially its entire length by conventional means such as by the combination of a mounting strip and screws. The free, or lower, end of the curtain 14 is provided with a bottom rail 15 which affords a degree of rigidity and protects the curtain's lower edge from impact damage.

A first mounting bracket 20 is securely affixed to a first upper panel 42 at the upper end of the first side frame 32. Similarly, a second mounting bracket 22 is securely affixed to a second upper panel 44 at the upper end of the second side frame 34. The first mounting bracket 20 is securely coupled to and provides support for a first end of the tube 16, while the second mounting bracket 22 is coupled to and provides support for a second end of the tube. Each of the first and second mounting brackets 20, 22 includes a suitable bearing arrangement to allow the tube 16 to freely rotate relative to the mounting brackets.

Referring also to FIG. 2, which is a partially cutaway side planar view of the roll-up door 10, and FIG. 3, which is a partially cutaway planar view of a portion of the roll-up door, additional details of the roll-up door of the present invention will now be described. Also mounted to the second upper panel 44 at the upper end of the second side frame 34 are an electric motor 24, a controller 26 and a gear reduction box 40. The electric motor 24 and controller 26 are coupled to an electrical power supply (not shown) and are also coupled together. The electric motor 24 is further coupled to the gear reduction box 40 which, in turn, is coupled to and provides for the rotational displacement of a drive shaft 19 coupled to and extending from one end of the tube 16. The combination of the electric motor 24, the controller 26 and the gear reduction box 40 thus rotationally displace the tube 16 via the drive shaft 19 for raising and lowering the curtain 14. While the controller 26 is shown in the various figures disposed in an upper portion of a side frame, the controller may also be mounted to a lower portion of a wall adjacent to the roll-up door to facilitate operator access to the controller.

A first pulley 28 is coupled to a non-driven support shaft 18 and is free to rotate thereon. The support shaft 18 is coupled to the other end of the tube 16 and provides support therefor. Similarly, a second pulley 30 is rotationally mounted to the drive shaft 19. Positioned on and disposed about the first pulley 28 is a first belt 48, while a second belt 50 is positioned upon and disposed about the second pulley 30. With a first end of each of the first and second belts 48, 50 securely attached to the first and second pulleys 28, 30, respectively, the second end of each of these belts is attached to the bottom rail 15 of the curtain 14 as shown in FIG. 2 for the second belt. With the first and second pulleys 28, 30 coupled to the tube 16 in a manner described below, the curtain 14 may be wound onto or unwound from the tube while maintained in a stretched condition under tension. A lower pulley 60 is mounted in the lower portion of each of the side frames. A respective belt is wound around each of the lower pulleys 60 as shown for the case of belt 50 in FIG. 2. The manner in which tension is applied to and maintained on the curtain 14 is described in detail below.

Referring specifically to FIG. 3, there is shown additional details of the manner in which the operation of the roll-up door 10 is controlled. Disposed within the second side frame 34 are a plurality of sensor switches, each of which is coupled to the controller 26. These sensor switches include an upper open limit switch 66, an intermediate slow approach limit switch 68, and a close limit switch 70. Each of the aforementioned limit switches includes a trip arm which is engaged by an end portion 64 of the bottom rail 15. The end portion 64 of the bottom rail extends into the second side frame 34. As the end portion 64 moves up and down within the second side frame 34 as the curtain 14 is retracted and extended, the end portion of the bottom rail engages the respective trip arms of the various limit switches. Thus, upon retraction of the curtain 14, the end portion 64 first trips the slow approach limit switch 68 and then the open limit switch 66. Tripping of the slow approach limit switch 68 reduces the upward retraction speed of the curtain 14 and allows it to assume a lower speed just prior to reaching the full up position. The full up position of the curtain 14 is detected by the open limit switch 66 which provides an appropriate control signal to the controller 26 for terminating upward displacement of the curtain. The slow approach limit switch 68 thus allows the roll-up door 10 of the present invention to operate at two speeds during retraction, i.e., an initial high speed as curtain retraction is initiated and a reduced, slower speed as the curtain approaches the full up position. The slow approach limit switch 68 is not used during lowering of the curtain 14 to the closed position. The close limit switch 70 is tripped by the bottom rail's end portion 64 to provide detection of the curtain as it approaches the full down position and to terminate further downward displacement. The curtain 14 is thus displaced at two different speeds when retracted and is extended, or lowered, at a single lower speed.

Referring to FIG. 4, there is shown a sectional view of the second side frame 34 taken along sight line 4—4 in FIG. 1. The first and second side frames 32, 34 are essentially mirror images of one another. The side frame 34 includes first and second flats 74 and 76 preferably comprised of steel and coupled together by conventional means such as a weldment to form an L-shaped structure. Conventional means such as mounting brackets and bolts are used for securely mounting the first flat 74 to a wall 72. Disposed on a distal end of the second flat 76 is an angle 77 as well as a hinge 78. The hinge 78 pivotally couples a closure panel 80 to the distal end of the second flat 76. The closure panel 80 is shown in solid lines in the closed position and in dotted lines in the open position. The capability to open up the second side frame 34 to allow access to the components of the roll-up door therein facilitates maintenance and repair of the door installation.

The inner portion of the second side frame 34 includes first and second box beams 84 and 86 to which are respectively coupled to first and second guide rails 88 and 90. The first box beam 84 may be securely coupled to the first flat 74 as well as to upper and lower portions of the second side frame 34 to ensure its secure and stable positioning therein. Similarly, the second box beam 86 may be securely coupled to upper and lower portions of the second side frame 34 to provide for its secure and stable positioning therein. A third flat 82 is coupled to the second box beam 86 and is positioned so as to engage the closure panel 80 when in the closed position. With the closure panel 80 closed, the components of the roll-up door disposed within the second side frame 34 are protected from damage by contact with moving vehicles and are isolated from the surrounding environment which tends to improve the performance and increase the reliability of the roll-up door.

A guide slot 92 disposed between and defined by the first and second guide rails 88, 90 is adapted to receive an end of the roll-up door's bottom rail. The roll-up door's end portion is freely movable between the first and second guide rails 88, 90 along the length thereof yet remains confined between these guide rails as the roll-up door is extended and retracted. The guide slot 92 which receives the end portion of the roll-up door's bottom rail thus ensures that the lower end of the roll-up door is displaced substantially vertically with little or no lateral movement during extension and retraction of the door. In addition, the first and second guide rails 88, 90 maintain the curtain laterally stretched and generally planar even when the curtain is subjected to a pressure differential across the opening over which it is positioned. By thus maintaining an end portion of the roll-up door's bottom rail within a respective side frame, the roll-up door is provided with a high degree of wind resistance in a door construction which is lightweight and capable of being displaced at high speeds without the requirement for reinforcing the curtain to increase its strength.

Referring to FIG. 5, there is shown a longitudinal sectional view of the drive mechanism used to roll and unroll a curtain as well as to maintain the curtain in a stretched condition in accordance with the present invention. As previously described, the curtain (which is not shown in FIG. 5 for simplicity) is disposed about the tube 16 along the length thereof in a rolled manner. Coupled to and positioned within respective open ends of the tube 16 are first and second outer end hubs 114 and 134. Each of the first and second outer end hubs 114, 134 is secured to a respective end of the tube 16 such as by weldments. Each of the first and second outer end hubs 114, 134 includes a respective center aperture within which are respectively disposed the non-driven support shaft 18 and the drive shaft 19. The support shaft 18 further extends through an aperture in the first pulley 28, while the drive shaft 19 extends through an aperture in the second pulley 30.

Disposed about the support shaft 18 where it extends through the first pulley 28 and the first outer end hub 114 is an inner anti-friction bearing 100. Disposed about and in contact with the inner anti-friction bearing 100 is an outer anti-friction bearing 102 which is securely coupled to the first pulley 28 as well as to a first inner hub 106 disposed within the tube 16. An outer bearing angle 104 is securely coupled to the first outer end hub 114 and is disposed between the first outer end hub and the outer anti-friction bearing 102. The outer bearing angle 104 is further disposed between the first outer end hub 114 and the first inner hub 106 and allows for the relative rotational displacement therebetween. Therefore, the first pulley 28, the first outer end hub 114 and the first inner hub 106 are all free to rotate about the support shaft 18. In addition, the outer anti-friction bearing 102 is rigidly coupled to the first pulley 28 and the first inner hub 106 to ensure that these two components rotate in unison about the axis of the support shaft 18.

Disposed within and aligned along the length of the tube are first and second coiled torsion springs 108 and 128. One end of the first coiled torsion spring 108 is coupled to the first inner hub 106, while the second end of the first coil spring is coupled to a second inner hub 110 within the tube 16. The second inner hub 110 is securely coupled to the support shaft 18 as well s to the tube 16. Similarly, a third inner hub 112 is securely and fixedly coupled to both the support shaft 18 and the tube 16. Each of the second and third inner hubs 110, 112 includes a respective center aperture through which the support shaft 18 is inserted, with the outer periphery of each of these hubs attached to the inner surface of the tube 16 by conventional means such as a weldment.

A similar arrangement is provided for at the other end of the tube 16. Thus, an inner anti-friction bearing 120 is disposed in contact with and about the drive shaft 19. Disposed about the inner anti-friction bearing 120 is an outer anti-friction bearing 122 which is securely coupled to the second pulley 30 as well as to a fourth inner hub 126 positioned within the tube 16. Disposed about and positioned in contact with the outer anti-friction bearing 112 is an outer bearing angle 124 which is securely coupled to and rotates with the second outer end hub 134. As in the case of the first outer end hub 114, the second outer end hub 134 is securely coupled to the end of the tube 16 by conventional means such as a weldment. The inner, angled portion of the outer bearing angle 124 is disposed between the fourth inner hub 126 and the second outer end hub 134 and provides for proper spacing therebetween. In addition, the outer bearing angle 124 permits rotational displacement between the fourth inner hub 126 and the second outer end hub 134.

One end of the second coiled spring 128 is coupled to the fourth inner hub 126, while the other end of the coiled spring is coupled to a fifth inner hub 130. The fifth inner hub 130 is securely coupled about its periphery to the inner surface of the tube 16 and includes a center aperture through which the drive shaft 19 extends. A sixth inner hub 132 is similarly positioned within the tube and securely coupled about its outer periphery to the inner surface of the tube. The sixth inner hub 132 also includes a center aperture through which the drive shaft 19 extends. The fifth and sixth inner hubs 130, 132 are both securely coupled to the drive shaft 19 so as to rotate therewith.

Figure 6:
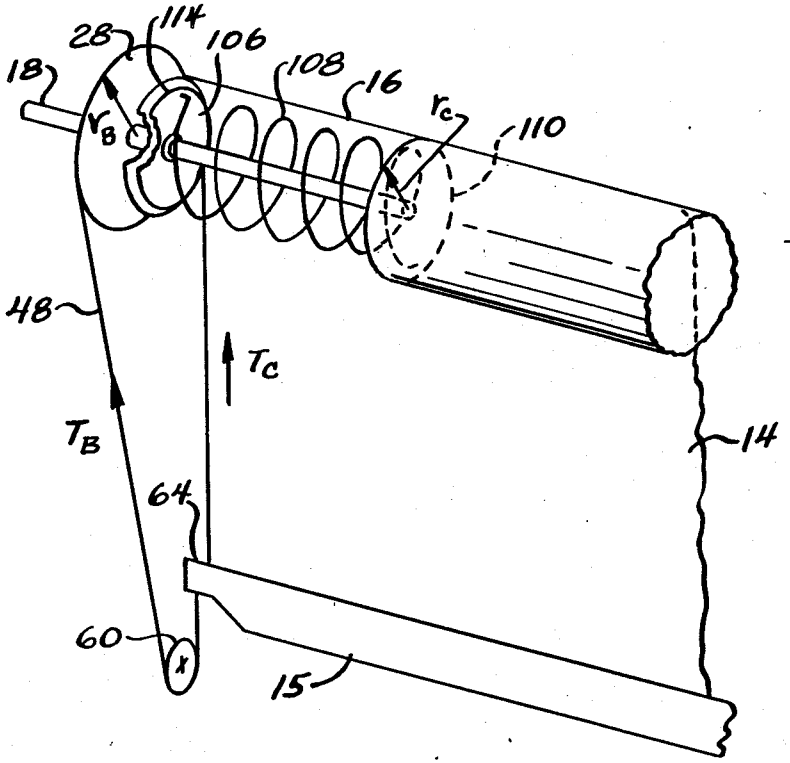
FIG. 6 is a partially cutaway perspective view shown in simplified schematic form of a belt and pulley arrangement in combination with a roller tube for use in the roll-up door of the present invention.

Referring to FIG. 6, there is shown in simplified schematic form a partially cutaway perspective view of a portion of the roll-up door of the present invention. As shown in FIG. 6, the curtain 14 is wound around the tube 16 and extends downward with the bottom rail 15 positioned on its lower edge. The bottom rail's end portion 64 is securely coupled to one end of the first belt 48 which is wound around the lower pulley 60. The first belt 48 extends upward to the first pulley 28 about which the belt is wound and to which it is securely coupled. The support shaft 18 extends through the first pulley 28 as well as through the first outer end hub 114 and the first inner hub 106. The inner end of the support shaft 18 is coupled to the second inner hub 110 shown in dotted line form in the figure. The coiled spring 108 is disposed about the support shaft 18 and is coupled at respective ends thereof to the first inner hub 106 and the second inner hub 110.

The coil spring, tube and pulley arrangement illustrated in FIGS. 5 and 6 operates in the following manner to maintain the curtain 14 in a tightly stretched condition and to counterbalance the weight of the curtain withdrawn from the tube 16. The two belts 48, 50 are wound around respective pulleys 28, 30 in a direction opposite to the direction in which the curtain 14 is wound around the tube 16. Thus, as the curtain 14 is removed, or pulled off of, the tube 16, each of the belts is wound onto a respective pulley. Similarly, as each of the belts is unwound from its respective pulley, the curtain 14 is wound around the tube 16. The first and second pulleys 28, 30 and the tube 16 are urged in opposite directions of rotation by the first and second coiled springs 108, 128. For example, with the outer end of the first coiled spring 108 coupled to the first pulley 128 via the first inner hub 106 and outer anti-friction bearing 102, the first pulley 28 is urged in a counterclockwise direction of rotation as viewed in FIG. 6. On the other hand, with the other end of the first coiled spring 108 coupled to the tube 16 via the second inner hub 110, the tube is urged in a clockwise direction of rotation as viewed in FIG. 6. By thus urging the first and second pulleys 28 and 30 in an opposite direction of rotation from that of the tube 16, the curtain 14 as well as the first and second belts 48 and 50 are maintained in a tightly stretched condition. Although the first and second pulleys 28, 30 and the tube 16 are urged in opposite directions of rotation, the pulleys are rotated in the same direction as that of the tube during extension and retraction of the curtain. However, during retraction and extension of the curtain the two pulleys rotate at a different rate, or velocity, than the tube, with the two larger pulleys always seeking to "catch up" to the rotating tube.

The assembly illustrated in FIGS. 5 and 6 operates in the following manner to counterbalance the weight of the curtain 14 as it is withdrawn from the tube 16. The length of the curtain 14 paid out with each revolution of the tube 16 is equal to $2\pi r_C$, where $r_C$ is the radius of the tube. Similarly, the length of belt taken out by each of the two pulleys with each revolution of the tube 16 as the curtain 14 is withdrawn is also equal to $2\pi r_C$. But the circumference of the first pulley 28 is equal to $2\pi r_B$, and $r_B > r_C$. Therefore, with $r_B > r_C$, the two pulleys make only a partial revolution with each complete revolution of the tube 16 as the curtain 14 is withdrawn therefrom. Because the curtain end of each of the coil springs 108, 128, i.e., their respective inner ends which are coupled to inner hubs 110 and 130, make a full revolution with each revolution of the tube 16, and the pulley, or outer end, of each of these springs makes only a partial revolution with each revolution of the tube, each of these springs is maintained in a wound condition. The winding of the first and second coil springs 108, 128 produces a torque about the support shaft 18 as well as the drive shaft 19. This torque maintains the curtain 14 and belt 48 combination under tension as previously described.

In order to maintain this combination in balance, the tension in each leg, i.e., in the two belts 48, 50 as well as in the curtain 14, must be equal. The tension is equal to the torque ($T_Q$) divided by the radius arm. In order for the belt tension ($T_B$) to equal the curtain tension ($T_C$), the two radii, i.e., $r_B$ and $r_C$, must be equal. This torque, or tension, is calibrated by fixing $r_B$ with the initial layers of the belts wrapped around the pulleys, such that $r_B \geqq r_C$ with the curtain 14 in the fully open position. If $r_B = r_C$, the tension in the belts and the curtain 14 is in balance. If $r_B > r_C$, there is a resultant upward force exerted on the curtain 14 tending to retract the curtain to the full open position. If $r_B > r_C$, the curtain 14 is urged to the extended position and the belts will be wound around the pulleys. The changing effective radii of the first and second pulleys 28, 30 as their respective belts are wound around or unwound therefrom in combination with the changing effective radius of the tube 16 as the curtain 14 is wound upon or unwound therefrom provides an efficient and effective counterbalancing arrangement to accommodate the changing effective weight of the curtain as it is wound/unwound.

There has thus been shown a roll-up door which is capable of high speed operation, uses a reduced number of components, offers highly reliable operation, and is relatively inexpensive. The roll-up door includes a roller tube mounted flexible curtain which is maintained in a tightly stretched condition, with the weight of the withdrawn curtain always counterbalanced to permit high speed movement of the curtain during extension and retraction.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A roll-up door disposed across an aperture in a wall, said door comprising:

a cylindrical tube disposed adjacent to an upper portion of the aperture;

a flexible curtain coupled to and wound around said tube in a first direction of winding;

a first support shaft coupled to a first end of said tube and a second drive shaft coupled to a second end of said tube, said drive shaft further coupled to drive means for rotationally displacing said tube;

first and second pulleys respectively mounted to said first support shaft and said second drive shaft;

first and second belt means respectively coupled to and wound around said first and second pulleys in a second, opposed direction of winding for coupling said pulleys to a free end of said curtain;

biasing means including first and second coiled torsion springs respectively disposed about and along the lengths of said first support shaft and said second drive shaft, wherein each of said coiled torsion springs is coupled at their respective ends to said tube and to one of said pulleys for rotationally urging said tube in said first direction of winding for rolling up said curtain on said tube and for rotationally urging said pulleys in said second, opposed direction of winding for rolling up said belt means on said pulleys so as to maintain said curtain in a tightly stretched condition;

first and second inner hubs and third and fourth outer hubs, wherein each of said first and second inner hubs is coupled to a first inner end of a respective torsion spring and each of said third and fourth outer hubs is coupled to a second outer end of a respective torsion spring;

fifth and sixth end hubs disposed on respective ends of said tube and through which said first support and said second drive shafts extend; and first and second bearing means disposed respectively between said first end hub and said first support shaft and between said second end hub and said second drive shaft for facilitating rotational displacement between said tube and said pulleys;

wherein changes in the length of curtain unwound from said tube are compensated for by corresponding changes in a roll-up torque exerted on the belt means by the pulleys and biasing means so as to counterbalance the weight of curtain removed from said tube and maintain the curtain in equilibrium as it is unwound from and wound onto said tube.

2. The roll-up door of claim 1 further comprising first and second sleeves respectively disposed about said first support and said second drive shafts and coupling said first end hub to said first pulley and said second end hub to said second pulley, respectively.

3. The roll-up door of claim 2 further comprising seventh and eighth innermost hubs coupled to said tube and further respectively coupled to an inner end of said first support and second drive shafts.

4. The roll-up door of claim 1 further comprising third and fourth pulleys positioned adjacent to respective lower side portions of the aperture and about which said first and second belt means are respectively wound.

5. The roll-up door of claim 1 further comprising a bottom rail attached to a lower end of said curtain.

6. The roll-up door of claim 5 further comprising first and second guide means disposed adjacent to respective lateral portions of the aperture for engaging respective ends of said bottom rail and maintaining said curtain in a laterally stretched condition.

7. The roll-up door of claim 1 further control means coupled to said second drive shaft for rotationally displacing said drive shaft in extending and retracting said curtain.

8. The roll-up door of claim 7 wherein said control means includes a controller, an electric motor and a gear reduction mechanism.

9. The roll-up door of claim 8 further comprising detection means for detecting the position of the lower end of the curtain within the aperture.

10. The roll-up door of claim 9 wherein said detection means includes an open limit switch, a close limit switch, and a speed change switch.

11. The roll-up door of claim 1 wherein said curtain is comprised of a lightweight polyvinyl chloride material.

12. The roll-up door of claim 11 wherein said polyvinyl chloride material is transparent.

* * * * *